United States Patent [19]

Blunier et al.

[11] Patent Number: 5,024,074

[45] Date of Patent: Jun. 18, 1991

[54] APPARATUS AND METHOD FOR SELECTIVELY FORMING A THICKENED EDGE ON A PLATE OF FORMABLE MATERIAL

[75] Inventors: Dennis L. Blunier, Danvers; Phillip J. Shankwitz; Maurice L. Caudill, both of Peoria; Ronald C. Bowar, Chillicothe; Dwight E. Aussieker, Varna, all of Ill.

[73] Assignee: Caterpillar Inc., Peoria, Ill.

[21] Appl. No.: 354,187

[22] Filed: May 19, 1989

[51] Int. Cl.[5] ..... B21D 19/00; B21D 19/04

[52] U.S. Cl. ..... 72/16; 72/199; 72/224

[58] Field of Search ..... 72/16, 31, 34, 199, 72/207, 210, 214, 224, 240, 366; 228/17, 173.3, 173.6, 173.7

[56] References Cited

U.S. PATENT DOCUMENTS

| | | | |
|---|---|---|---|
| 68,936 | 9/1867 | Baines . | |
| 98,807 | 1/1870 | Sellers . | |
| 910,471 | 1/1909 | Fraser et al. . | |
| 917,765 | 4/1909 | Hoskins . | |
| 936,109 | 10/1909 | Fraser et al. . | |
| 1,040,398 | 10/1912 | Parmelee . | |
| 1,109,521 | 9/1914 | Fraser . | |
| 1,963,724 | 6/1934 | Taylor | 80/40 |
| 2,063,798 | 12/1936 | Firth | 29/33 |
| 2,184,150 | 12/1939 | Parker et al. | 76/104 |
| 3,055,241 | 9/1962 | Hedgecock et al. | 80/31.1 |
| 3,336,778 | 8/1967 | Follrath | 72/203 |
| 3,400,566 | 9/1968 | Gauer | 72/199 |
| 3,402,586 | 9/1968 | Müller | 72/225 |
| 3,566,656 | 3/1971 | Matsumuro | 72/227 |
| 3,602,022 | 8/1971 | Conrad | 72/40 |
| 4,555,921 | 12/1985 | Matsuda et al. | 72/224 |
| 4,658,615 | 4/1987 | Mitchell | 72/16 |

*Primary Examiner*—E. Michael Combs

*Attorney, Agent, or Firm*—Sterling Richard Booth, Jr.; Robert E. Muir

[57] ABSTRACT

In conventional fabrication manufacture the thickness of the steel plates are often determined by the metal section required at the weld joints. The subject apparatus and method overcomes this problem by selectively forming a thickened edge along the edge of a thinner steel plate which can now be limited to the thickness required to withstand the stresses on the fabrication. The thickened edge is produced by forcing a plate supported by a table, by passing the plate through a forming apparatus comprised of a combination of rollers. The forming apparatus and table are automatically controlled to produce a thickened edge of constant shape along a non-linear edge of the plate.

20 Claims, 9 Drawing Sheets

APPARATUS AND METHOD FOR SELECTIVELY FORMING A THICKENED EDGE ON A PLATE OF FORMABLE MATERIAL

DESCRIPTION

1. Technical Field

This invention relates to an apparatus and method for selectively forming a thickened edge on a plate of formable material including means for maintaining a substantially constant pressure between the forming means and the edge of the plate.

2. Background

A large portion of many construction machines consists of large fabrications which are manufactured by welding several different shaped metal plates of steel together. Due to the physics of the welding process, the section of material required to make the weld joint as strong as the plate must be thicker than the rest of the plate in most instances. As shown by FIG. 11 of the patent drawings, stress concentration immediately adjacent to the weld can cause a weakened area at the joint resulting in structural failure to the fabrication.

The conventional cure for this problem is to use a thicker plate to increase the section of material at the weld joint. This in turn creates the added problems of needlessly increasing the weight of the fabrications since the entire plate is thicker than necessary. This causes attaching problems with other components resulting in a chain of events resulting in increasing their size, i.e., larger bolts, bigger bolt mountings, increased sizes of castings, etc. This chain of events results in the major problems of increasing machine size and weight; using more material, further reducing the availability of such material; and increasing the cost of the machines. This ultimately results in higher cost of roads, dams, etc.

The assignee has unsuccessfully investigated and searched the industry to find equipment to manufacture the different shapes of the components of their fabrications with thickened edges. The following patents that generally teach the state of the art were found in a search in the United States Patent and Trademark Office;

U.S. Pat. No. 68,936—This patent teaches forming a railroad track and not a thickened edge on a plate. There are no anti-buckling rollers associated with the forming rollers nor a table for holding a plate so its edges can be formed.

U.S. Pat. No. 98,807—As with U.S. Pat. No. 68,936 this patent teaches forming a special shaped rod of material not associated with a plate.

U.S. Pat. No. 910,471—As with the above patents, the apparatus shown does not have anti-buckling rollers in combination with the forming rollers and the arrangement would not be adaptable to plates with non-linear edges.

U.S. Pat. No. 917,765—This patent teaches passing a narrow plate of material through a set of rollers; however, they are not adaptable to large plates having a non-linear edge which requires a table and anti-buckling rollers to support the plate.

U.S. Pat. No. 936,109—As with the above patents, the apparatus shown does not have anti-buckling rollers in combination with the forming rollers and the arrangement without a holding table would not be adaptable to plates with non-linear or non-parallel edges.

U.S. Pat. No. 1,040,398—As With the above patents, the apparatus shown does not have anti-buckling rollers in combination with the forming rollers and the arrangement would not be adaptable to plates with non-linear or non-parallel edges.

U.S. Pat. No. 1,109,521—As with the above patents, the apparatus shown does not have anti-buckling rollers in combination with the forming rollers and the arrangement would not be adaptable to plates with non-linear or non-parallel edges.

U.S. Pat. No. 1,963,724—This patent teaches using three steps to form the edge which are independent rollers running against a forming plate. As with the above patents, the tooling is limited to a straight, constant width plate and would not be adaptable to plates of different widths with non-linear edges.

U.S. Pat. No. 2,063,798—The single forming rollers of this patent use grooves to shape the edge. The plate is supported by rollers which are not adjacent to the forming rollers allowing the plate to buckle between the rollers. As with the above patents, there is no table to support the plate to allow different size plates to have their non-linear edges selectively formed.

U.S. Pat. No. 2,184,150—As with many of the above patents, the tooling disclosed herein is limited to a narrow strip of material which is continuously fed through a set of forming rollers. The rollers 14 and 16 have integral relieved portions cooperating with the edge roller 18 to form flange 12. The relieved portions being an integral part of rollers 14 and 16 would not allow them to be exchanged to accommodate different shapes required by different plates. Also, no table is required for the continuous feed.

U.S. Pat. No. 3,055,241—This patent discloses shaping the edges of a metal strip. There are no anti-buckling rollers and no table. Therefore, it would not be adaptable to large non-linear shaped plates.

U.S. Pat. No. 3,336,778—This patent discloses an edge forming apparatus adaptable to a continuous ribbon of metal. There are no anti-buckling rollers and as with some of the above disclosures, the forming takes place in a groove.

U.S. Pat. No. 3,402,586—The apparatus shown in this patent is only rounding the edges and is not thickening them, nor shaping for a weld joint. Further, there are no anti-buckling rollers or tables shown to support a plate.

U.S. Pat. No. 3,566,656—The tooling disclosed in this patent is like many of the above in that it is designed for a particular continuous section of material. Without a table, anti-buckling rollers and independent forming rollers it could not be adapted to large plates having non-linear edges.

U.S. Pat. No. 3,602,022—This patent discloses an edge forming apparatus adaptable to a continuous ribbon of metal. There are no anti-buckling rollers and as with some of the above disclosures, the forming takes place in a groove.

U.S. Pat. No. 4,555,921—This patent is concerned with sizing of a strip of metal, width and thickness. It does not teach a method nor apparatus for selective forming a thickened edge on a plate supported by a table wherein there is relative movement between the table and the forming rollers.

U.S. Pat. No. 4,658,615—The tooling disclosed in this patent does not include anti-buckling rollers or a table to support a plate to be moved relative to the forming rollers.

The above patents all have a common thread of similarity in that they are all designed for shaping a continuous strip or rod of steel. Many of the components of most fabrications are irregularly shaped, i.e., having non-linear and/or non-parallel edges. It would be impossible to feed them continuously through such apparatus. The shape of the plates to be processed with a thickened edge requires a table for supporting and holding them during the forming operation.

In addition to the deficiencies explained in connection with the above listed patents, there is also the problem of maintaining a variable load on the forming rollers as they move along the edge of an irregular shaped plate to provide a constant pressure of the forming rollers along a line of force perpendicular to the edge being worked. If a constant pressure cannot be maintained, the section of the thickened edge would not be consistent resulting in an inadequate weld joint.

The present invention is directed to overcome the problems as set forth above.

DISCLOSURE OF THE INVENTION

In one aspect of the invention, a method of forming a thickened edge on a plate of formable material having a non-linear edge by working the material on an edge of the plate into a prescribed thickness and shape comprises the steps of:

holding the plate on a supporting means such as a table with clamping means;

forming the edge of the plate by engaging the edge with a set of rollers by moving the table and rollers relative to each other;

applying force to the forming means in one direction toward the edge and in a magnitude sufficient to form the thickened edge; and, varying the forces to the forming means so that the magnitude sufficient to form the thickened edge is generally constant perpendicular to the edge of the plate.

In another aspect of the invention, an apparatus is provided to carry out the above method. The apparatus comprises a table for supporting a plate having a non-linear edge and/or non-parallel edges and means to clamp the plate to the table. Forming rollers for forming a thickened edge are mounted on an adjustable slide frame mounted in a load frame with means for applying a load to the adjustable slide and controls for adjusting the load to maintain a substantially constant normal force of the forming rollers against the edge of the plate to produce a substantially constant section of material in the thickened edge.

In a further aspect of the invention, the table moves in one direction crosswise to the direction of movement of the forming rollers. The forming rollers include a roller mounted perpendicular to the edge of the plate in combination with shaping rollers mounted parallel to the outer surfaces of the plate and adjacent to and rotatably independent of anti-buckling rollers also mounted parallel to the outer surfaces of the plate.

In a further aspect of the invention, a hydraulic control circuit is controlled by an electronic control that senses the linear position of the plate in relation to the forming means and other variables associated therewith to continuously adjust the pressure in a hydraulic cylinder to vary the load on the forming means to maintain a near constant pressure between the non-linear edge and/or non-parallel edges of the plate and the forming roller along a line of force extending from the axis of the forming roller and perpendicular to the edge of the plate.

The foregoing and other aspects of the invention will become apparent from the following detailed description when considered in conjunction with the accompanying drawings. It is expressly understood, however, that the drawings are not intended as a definition of the invention but are for the purpose of illustration only.

BRIEF DESCRIPTION OF THE DRAWINGS

FIG. 8 is a schematic view of various shapes and sizes of forming rollers that can be interchanged to produce various shaped thickened edges;

FIG. 11 is a section through a prior art weld joint; an

BEST MODE FOR CARRYING OUT THE INVENTION

Figure 1:
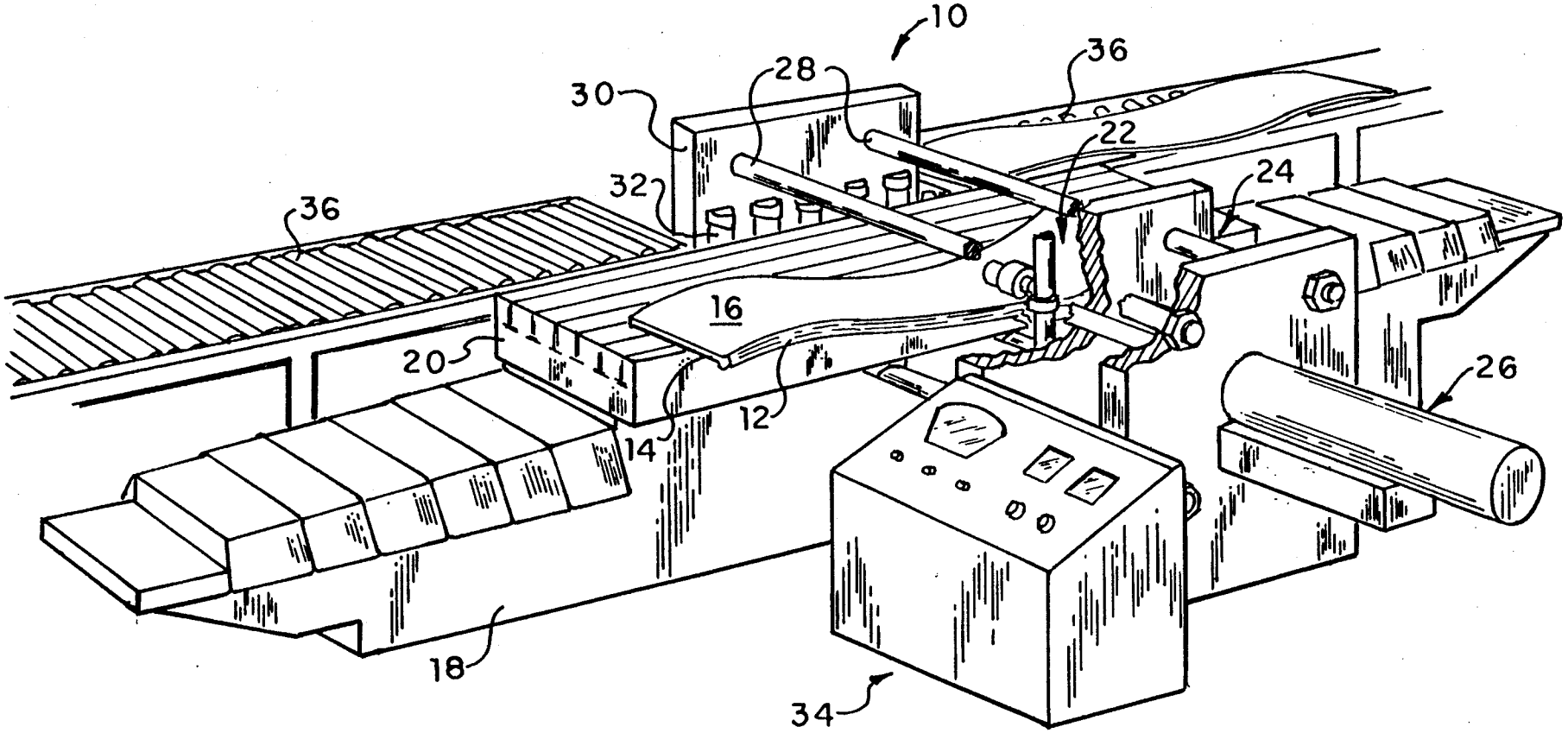
FIG. 1 is a perspective view of an apparatus embodying the present invention.

In the perspective view of FIG. 1, a general arrangement of an apparatus 10 for selectively forming a thickened edge 12 along the edge 14 of a plate 16 of formable material is illustrated. The apparatus 10 has a base 18 and a reciprocating support or table 20 for holding the plate 16 as the thickened edge 12 is being formed along the edge 14.

A forming apparatus 22 supported by a load frame 24 standing adjacent to the base and table, engages the edge 14 of the plate 16 to form the thickened edge 12. A load is applied to the forming apparatus 22 by a load applying means 26 also mounted in the load frame 24. The load frame 24, standing adjacent to the base and table, has tie bars 28 that extend across the table to a roller support bracket 30. Side thrust rollers 32 are rotatably mounted on the bracket 30 to engage a side of the table 20 to brace it against side loading of the forming apparatus 22 resulting from the pressure applied to the edge 14 of the plate 16. The side thrust can also be counteracted by providing side thrust bearings in machine ways between the table and base.

A control panel 34 is shown which contains the controls, described below, to control the selective forming apparatus 10.

Conveyors 36 shown in FIG. 1 provide means to carry the plates to be formed to and away from the apparatus.

Figure 2:
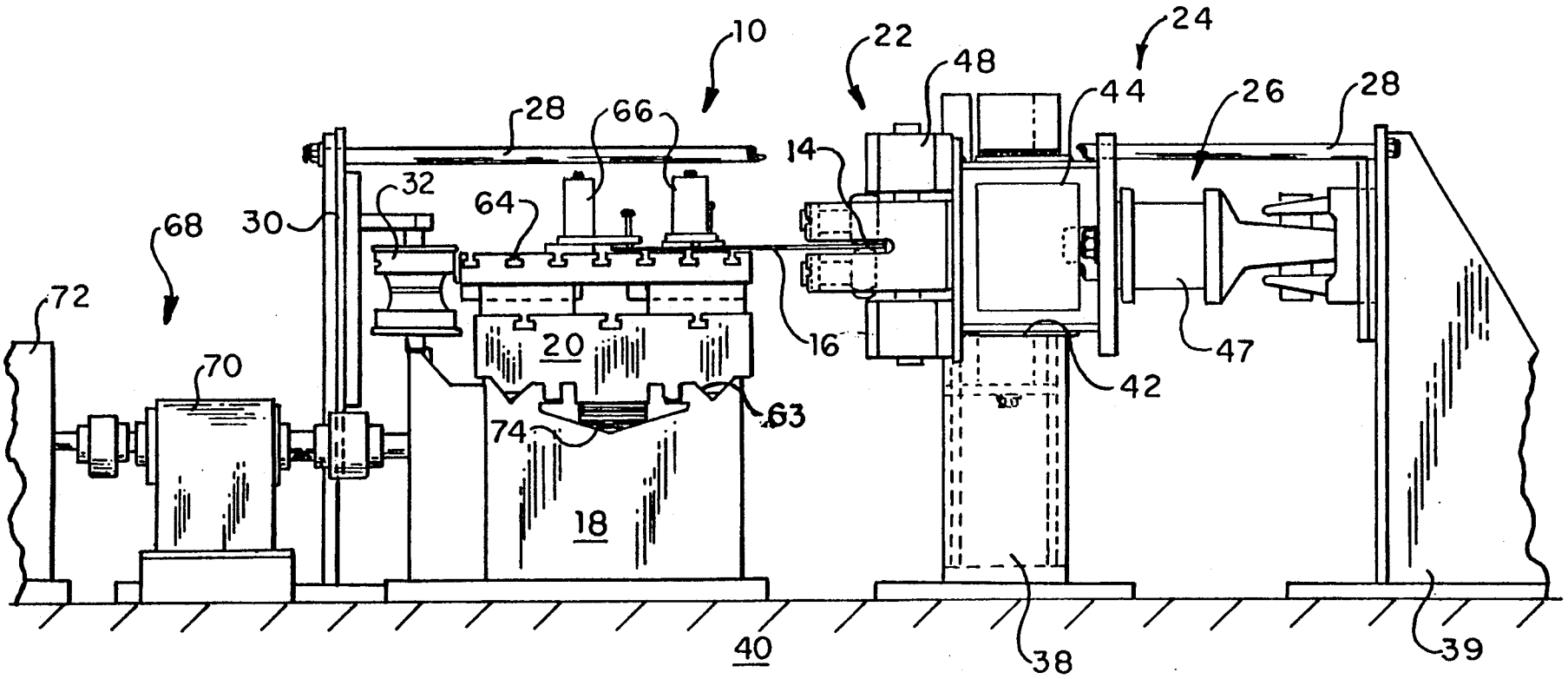
FIG. 2 is an elevational view of a preferred form of the apparatus with some areas broken away.

Referring to FIG. 2, a slightly modified version of the apparatus 10 is shown wherein the load frame 24 has two supports 38 and 39 extending upwardly from a mounting base or floor 40. The load frame 24 is positioned to the side and adjacent to the table 20 and base 18. The base 18 is also mounted or secured to the mounting base or floor 40.

Figure 4:
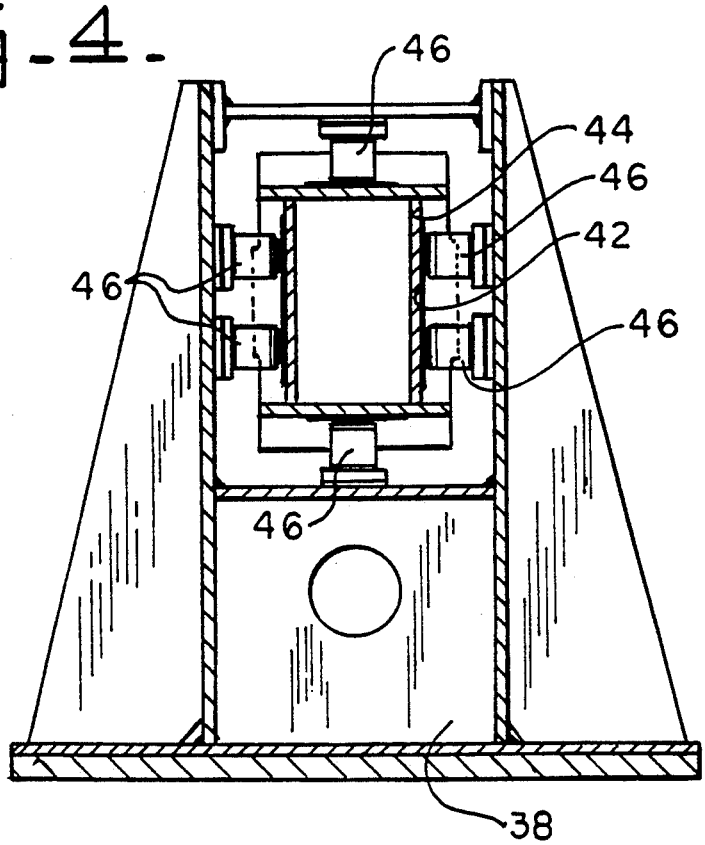
FIG. 4 is a cross sectional view taken through a support of the load frame and the slide for mounting the forming apparatus.

Mounted through a slide bearing 42, near the top of the support 38, is a slide frame 44. The details of the bearing and slide arrangement can better be seen in FIG. 4 which is a section taken through the slide 44. The bearing 42 is mounted within the support 38 wherein adjustable bearing members 46 are mounted. These adjustable bearing members are provided to maintain a close fitting relationship between the slide 44 and the support 38. Since they are adjustable, they can be adjusted to control the position of the forming apparatus 22 with respect to the edge 14 of the plate 16.

Referring back to FIG. 2, the load applying means 26 includes a motor or hydraulic cylinder 47, which applies the load to the slide frame 44, attached to one end of the slide frame 44 and anchored to the support 39 of the load frame 24.

Figure 5:
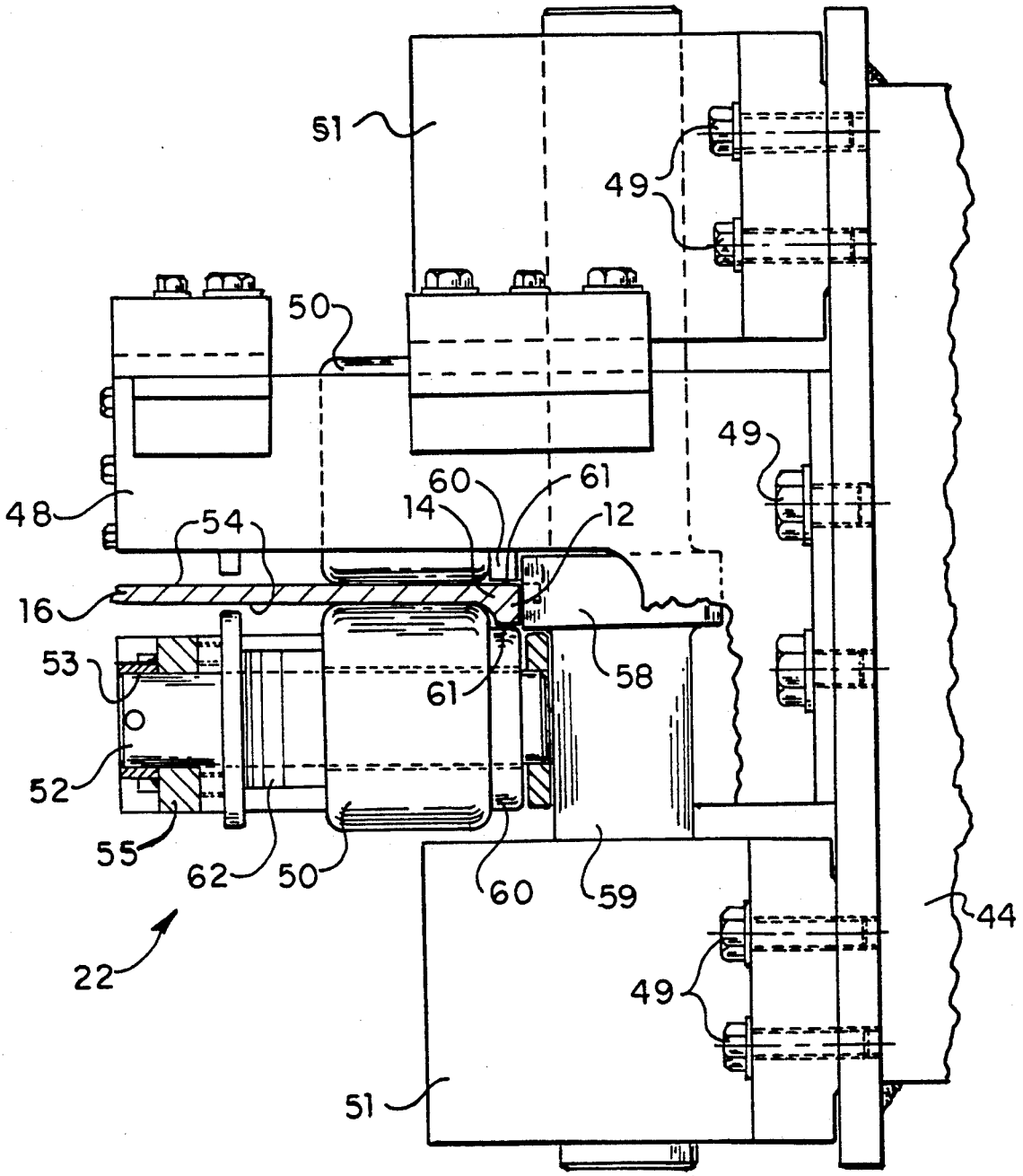
FIG. 5 is an enlarged view of the forming apparatus illustrating the relationship and mounting of the rollers.

The forming apparatus 22 is attached at the opposite end of the slide frame 44 where it is accessible to the edge 14 of the plate 16 supported on the table 20. The forming apparatus details can better be seen in FIG. 5, 6 and 7. The forming apparatus 22 is releasably mounted to the slide frame 44 by brackets 48 and pillow blocks 51 secured thereto with fasteners 49. Anti-buckling rollers 50 are rotatably mounted on shafts 52, only one of which is shown by a lower broken away portion of the bracket 48. The shafts 52 are mounted in bores 53 of a bracket 55.

The anti-buckling rollers 50 are mounted in a position to tightly engage both outer surfaces 54 of the plate 16. In this position, they grippingly hold the plate in the forming apparatus 22 to prevent buckling of the plate 16 as the edge 14 is being worked to form the thickened edge 12. The shafts 52 are mounted in adjustable brackets 55 attached to bracket 48 with fasteners 56 in slots 57 (see FIG. 7). The brackets can be adjusted to adapt the rollers 50 to plates 16 of different thickness.

The forming apparatus comprises a forming roller 58 mounted on a shaft 59 in the pillow blocks 51 perpendicular to the edge 14 of the plate 16. A pair of rollers 60 work in association with the forming roller 58 to control the shape of side surfaces 61 of the thickened edge 12. They are rotatably mounted on the shafts 52 adjacent to the anti-buckling rollers 50.

Figure 6:
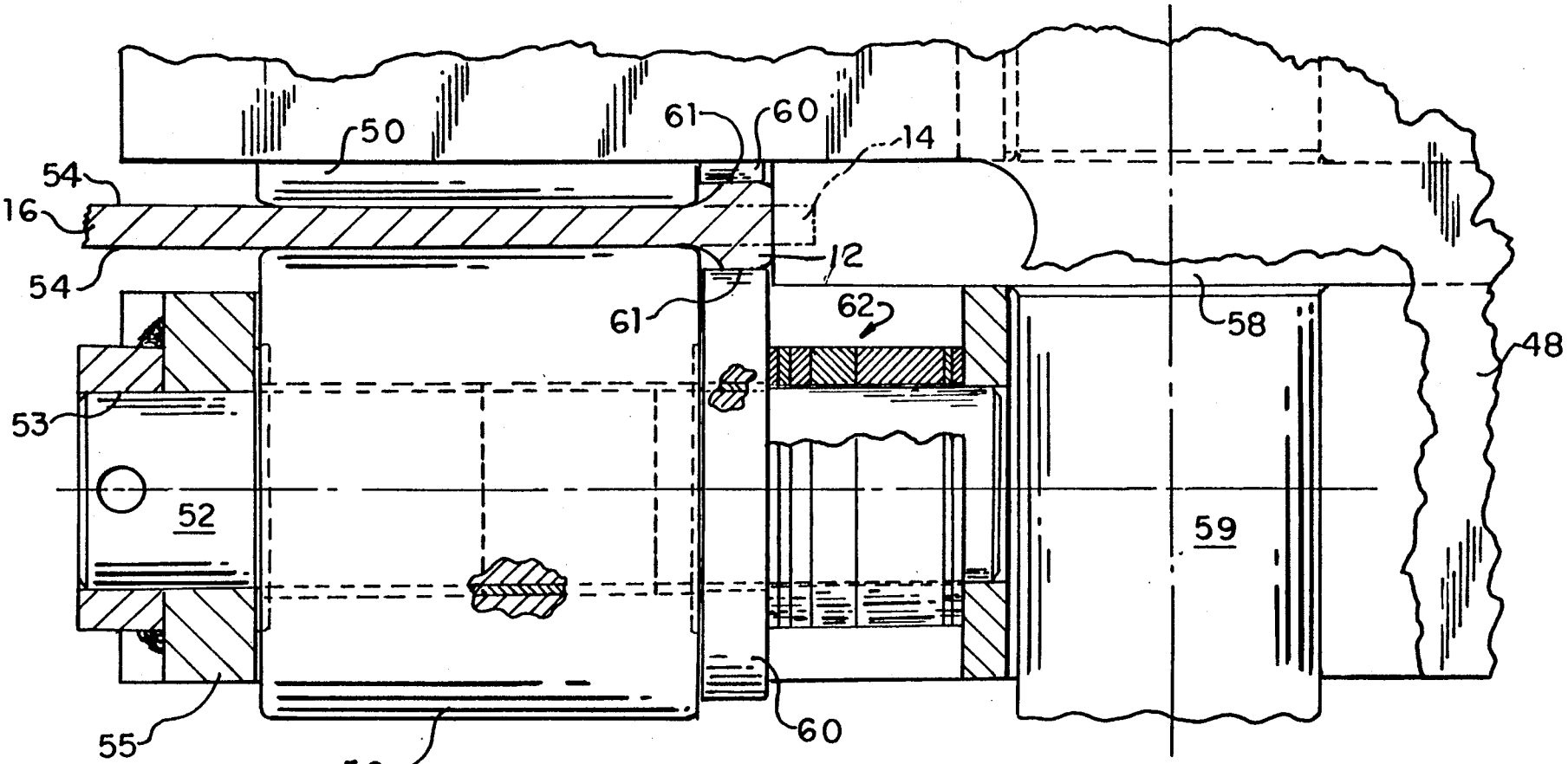
FIG. 6 is a further enlarged VieW of the rollers set in modified position to produce a thickened edge of a different shape with areas broken away to disclose bearings, adjustment shims, etc.
Figure 7:
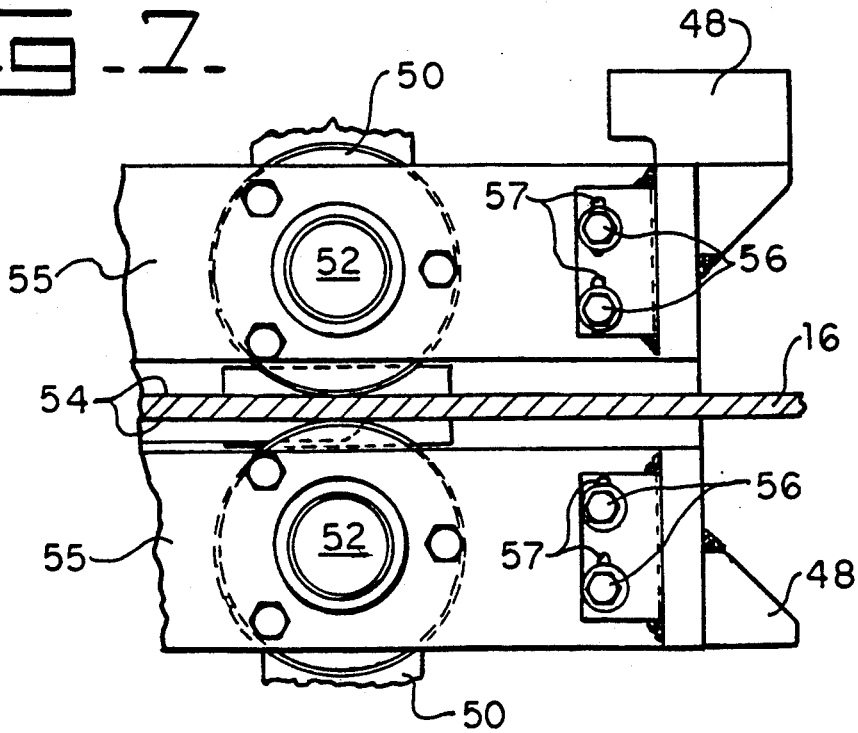
FIG. 7 is an enlarged view showing the relationship between the anti-buckling rollers and the plate and means for adjusting the pressure between the rollers and the plate.

As can better be seen in FIG. 6, the pair of rollers 60 are independently mounted on the shafts 52 so that their speed of rotation can be different than that of the anti-buckling rollers 50. Because of different diameters of the rolling surfaces of the anti-buckling rollers 50 and the pair of side surface forming rollers 60, the independent mounting eliminates scrubbing between the rollers and the surfaces being contacted. The pair of forming rollers 60 may also be changed to accommodate different shaped edges 61 required on the thickened edge 12.

FIG. 8 schematically illustrates several combinations of side surface 61 forming rollers 60. As shown therein they are not only changed to produce different shapes on the sides of the thickened edge 12, but also are changed to accommodate different thicknesses of plates 16.

A set of shims 62 on the shafts 52 can be moved from one side of the anti-buckling rollers 50 and the pair of rollers 60 to the opposite side to adjust the axial location of those rollers with respect to different diameter forming rollers 58.

The interchanging of the different pair of rollers 60 and the utilization of different diameter forming rollers 58 and the other adjustments described above allows the forming apparatus 22 to be modified to accommodate different shapes of thickened edges 12 as well as different thicknesses of plates 16.

Referring back to FIG. 2, the relationship between the base 18 and the table 20 can be seen. The table 20 is reciprocally mounted on the base 18 by machine ways 63. In this particular modification, the table 20 has T-slots 64 on its upper surface to receive clamps 66. The clamps 66 provide the means for holding the plate 16 securely on the table 20.

The plate 16 extends outwardly beyond an edge of the table 20 where its edge 14 makes contact with the rollers of the forming apparatus 22.

The table 20 is reciprocally moved relative to the base by a drive means 68. In this particular modification the drive means 68 includes a gear reduction box 70 powered by an electric motor 72. The gear reduction box 70 provides the proper reciprocating speed for the table 20 through a table drive mechanism 74.

Figure 3:
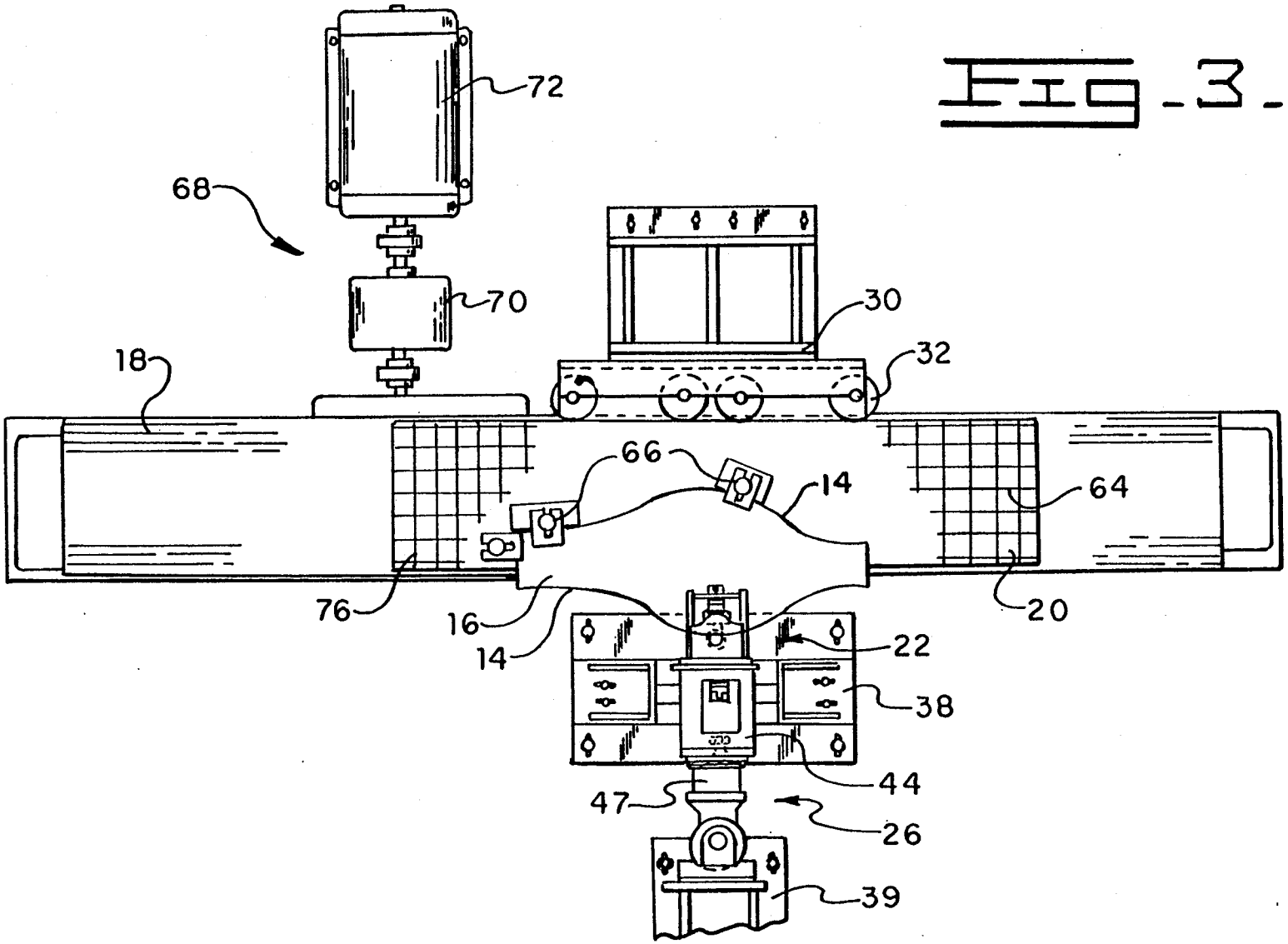
FIG. 3 is a partial plan view of the apparatus of FIG. 2 illustrating the relationship of the table, work piece and forming apparatus.

The horizontal relationship between the table 20, forming apparatus 22 and the work piece or plate 16 can be better seen in FIG. 3. In this view the plate 16 is shown clamped to the upper surface 76 of the table. The plate 16 has edges 14 having an irregular or non-linear shape. As set forth in the background of this application, the irregular shapes present a particular problem in the control of the forming apparatus 22 in order to maintain a constant perpendicular pressure between the forming roller 58 and the edge of the plate so as to control the shape and thickness of the thickened edge being formed.

Figure 9:
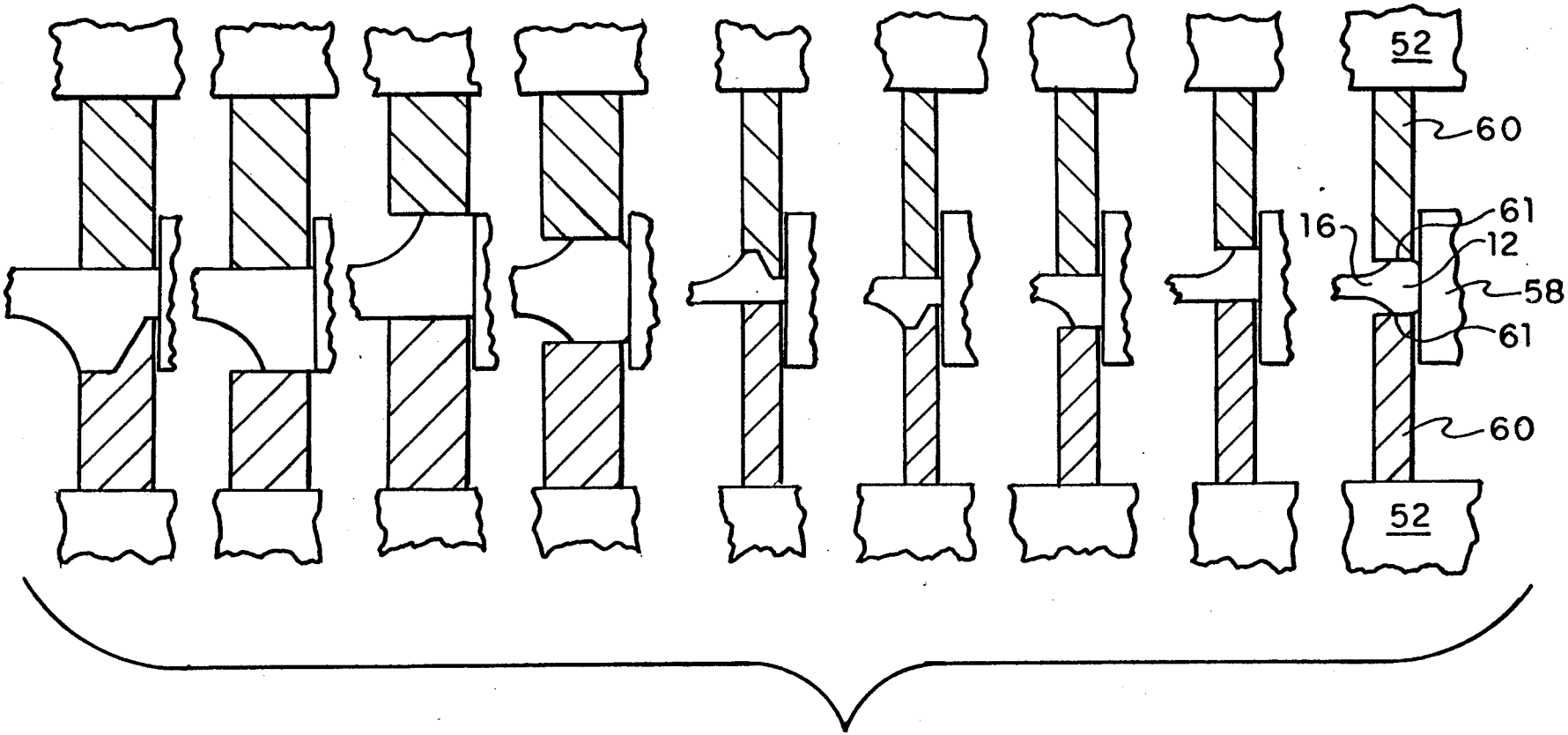
FIG. 9 is a schematic of the control for the apparatus.
Figure 9:
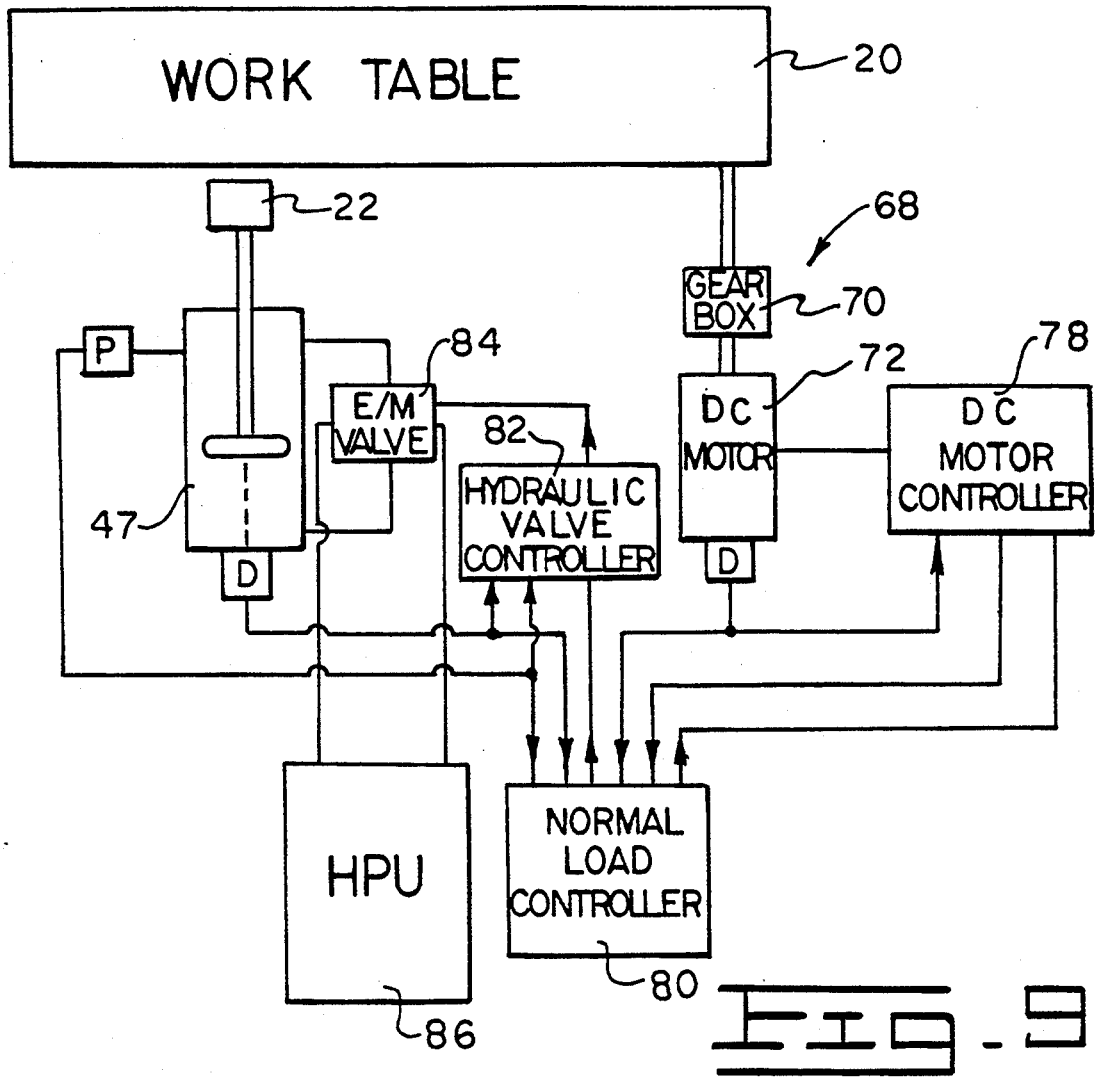

The control for this apparatus is schematically shown in FIG. 9. A DC motor controller 78 controls the speed of the motor 72 that powers the drive means 68 that reciprocates the table 20 forcing the plate 16 through the forming apparatus 22. A signal from the controller 78 is sent to a normal load controller 80. This signal which is an indication of the plate's position with respect to the forming roller 58 is compared to coordinates that correspond to the non-linear edge 14 of the plate 16.

The normal load controller 80 produces a signal that controls a hydraulic valve controller 82 which sends a signal to the hydraulic valve 84 that controls the load cylinder or motor 47 of the load applying means 26. The hydraulic fluid is supplied by a hydraulic pump 86. This adjusts the position of the load cylinder 47 and forming apparatus 22 with respect to the edge 14 of the plate 16.

A pressure signal from the load cylinder 47 is sent back to the normal load controller 80 comparing it with the prescribed pressure that the forming apparatus 22 should be experiencing and thereby further alter the position of the forming apparatus 22. Through such means the forming apparatus 22 is continually adjusted throughout the reciprocating of the work piece or plate 16 through the forming apparatus to maintain a constant thickened edge 12 section.

Figure 10:
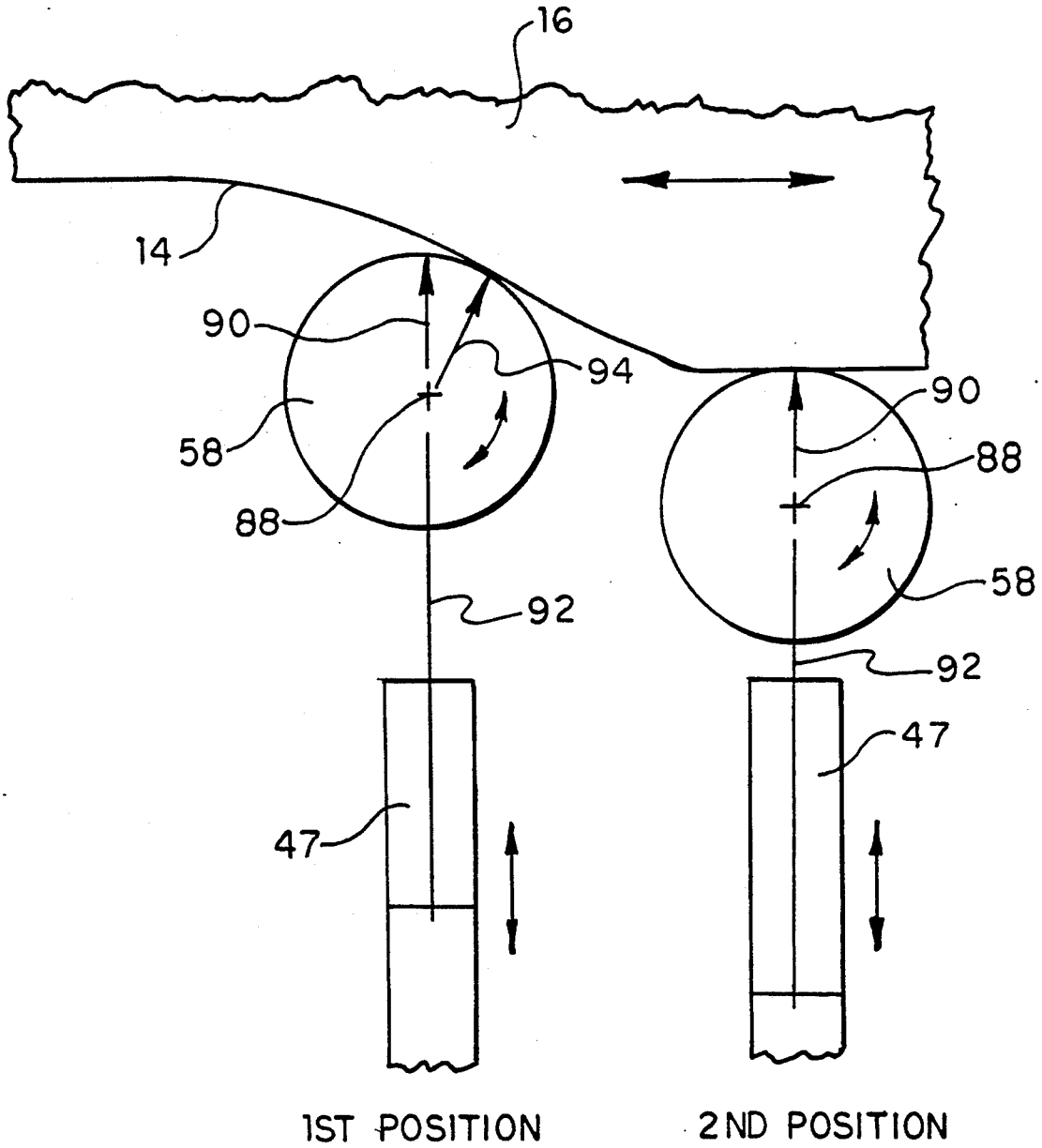
FIG. 10 is a force diagram illustrating the possible changes in the magnitude of the force required on the forming rollers along a non-linear edge.

Referring to FIG. 10, a force diagram is shown to illustrate the resultant forces experienced on the forming roller 58 of the forming apparatus 22. Due to the continuous changes of the angle of the edge 14 being presented to the forming roller, the forces between the edge 14 and the roller 58 perpendicular to an axis 88 of the roller 58 changes. As the angle of the edge 14 changes from the horizontal plane, the angle between the line of force 90 taken through the load cylinder 47 axis 9 and the angle of the resultant force taken on a line 94 between the axis 88 to a tangent point of the roller 58, i.e., perpendicular thereto, changes. Thus, the amount of pressure between the edge 14 and the forming roller 58 changes.

To counteract the decrease in force between the roller and the edge of the plate, the amount of pressure required in the load cylinder must increase to accommodate for the variation in this angle. The variation is illustrated in the first and second positions depicted and as the load roller approaches the edge that is perpendicular to the load cylinder (the second position), the pressure must again decrease to prevent the thickened edge from becoming thicker than prescribed for a particular part.

The controller may also be programmed in a manner to cause the forming apparatus to act intermittently along the edge of the plate so as to produce different shapes or only upset portions of the plate edge rather than the entire edge.

Figure 11:
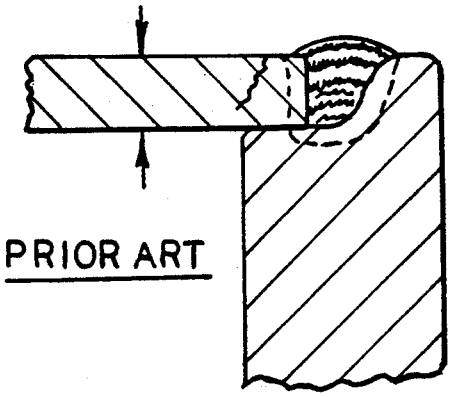
Figure 12:
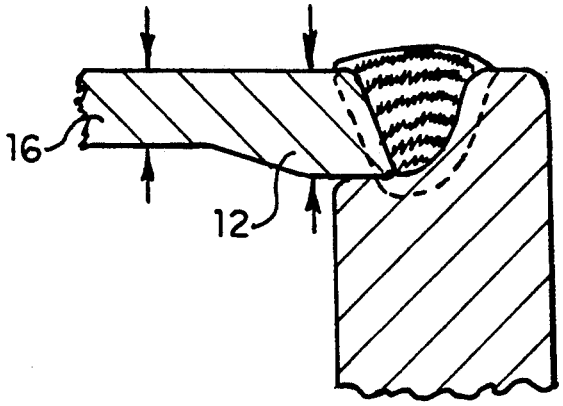
FIG. 12 is a section through a weld joint having a thickened edge produced by the apparatus and method described.

The above described apparatus can readily, selectively form a thickened edge automatically. One example is shown in FIG. 12 which is compared to the prior art of FIG. 11. A thickened edge 12 approximately fifty percent thicker than the original plate thickness is produced by reciprocating the plate through the forming apparatus 22. In this example the edge was cold formed and the forming apparatus required a load in the range of 60,000 pounds. It is to be understood that these dimensions are variables that change in accordance with the particular part, i.e., different thickness plate, different materials, edge shape requirements, etc.

This load may be reduced somewhat by zone heating the plate edge to the normal hot rolling temperature of the material which causes a reduction of the load required against the forming roller.

The plate may also be reciprocated through the forming apparatus a number of times, gradually shaping the thickened edge. This further reduces the force required from the single pass procedure.

Other aspects, objects and advantages become apparent from study of the specification, drawings, and amended claims.

We claim:

1. A method of forming a thickened edge on a plate of formable material having a non-linear edge by working the non-linear edge of the plate into a prescribed thickness and shape, comprising:

holding the plate and engaging the non-linear edge of the plate with a forming apparatus;

applying force to the forming apparatus in one direction toward the non-linear edge and in a magnitude sufficient to form the thickened edge;

moving the plate and the forming apparatus transversely relative to each other in a direction crosswise of the one direction; and sensing the non-linear edge and varying the force placed against the non-linear edge applied by the forming apparatus so that the magnitude thereof is substantially constant in a direction perpendicular to the non-linear edge of the plate to form a generally uniform thickened edge.

2. The method of forming a thickened edge on a plate of formable material, as set forth in claim 1, including moving the forming apparatus against the non-linear edge of plate, rotatably mounting a set of anti-buckling rollers adjacent the forming on shafts mounted parallel to outer surfaces of the plate, gripping the plate with the anti-buckling rollers, and moving the anti-buckling rollers with the forming apparatus.

3. The method of forming a thickened edge on a plate of formable material, as set forth in claim 2, wherein the forming apparatus includes a first roller rotatably mounted on a shaft perpendicular to the plate on the reciprocating bracket, and including the step of upsetting the non-linear edge of the plate the first roller.

4. The method of forming a thickened edge on a plate of formable material, as set forth in claim 3, including mounting a pair of rollers adjacent the anti-buckling rollers and spacing said pair of rollers a prescribed distance from each other, moving said pair of rollers with the first roller, and upsetting the material with the first roller to deform the material against the pair of rollers to form the thickened edge into the prescribed thickness.

5. The method of forming a thickened edge on a plate of formable material, as set forth in claim 1, including:

determining a position of the plate relative to the forming apparatus;

comparing the positioning of the plate with coordinates of the non-linear edge of the plate and producing a resulting signal; and processing the signal and controlling the force to the forming apparatus so that the force is continuously adjusted to maintain a substantially constant magnitude between the first roller and the non-linear edge of the plate in a direction perpendicular to the non-linear edge of the plate.

6. An apparatus for selectively forming a thickened edge on a plate of formable material by working the material along a non-linear edge of the plate to form the thickened edge into a desired shape and thickness, comprising:

a support and means for holding the plate on the support;

a forming apparatus adjacent the support;

a load frame for carrying the forming apparatus;

means for applying a load to the forming apparatus through the load frame;

means for sensing the orientation of the non-linear edge relative to the forming apparatus;

means for automatically adjusting the load to the forming apparatus to maintain a generally constant prescribed pressure on the non-linear edge of the plate as measured perpendicular thereto; and means for moving the support and load frame relative to each other to produce a prescribed thickened edge along the non-linear edge of the plate.

7. The apparatus, as set forth in claim 6, wherein the support is a table having a generally flat surface and a plurality of slots in the flat surface for receiving the means for holding the plate on the table.

8. The apparatus, as set forth in claim 7, including a machine base having elongated ways for reciprocally mounting the table on the base, and a motor for reciprocating the table relative to the base and the forming apparatus.

9. An apparatus for selectively forming a thickened non-linear edge on a metal plate, said thickened non-linear edge being thicker than the original thickness of said plate and having outer surfaces which blend smoothly into the outer surfaces of said plate, said apparatus comprising:

support means for supporting said plate as said thickened non-linear edge is being formed;

forming means for forming said thickened non-linear edge on said plate;

loading means for applying a force to said forming means in one direction toward the plate;

means for moving the support means and the forming means relative to each other in a direction cross-wise of said one direction;

means for sensing the orientation of the non-linear edge of the plate relative to said one direction; and control means responsive to the sensing means for varying said loading means to automatically adjust the force being applied to said forming means to maintain a substantially constant force against the non-linear edge of the plate in a direction perpendicular thereto, whereby the thickness and shape of said thickened non-linear edge will be generally constant.

10. The apparatus, as set forth in claim 9, wherein the forming means comprises a set of anti-buckling rollers rotatably mounted on first shafts parallel to side surfaces of the plate to engage the side surfaces, a first forming roller mounted on a second shaft perpendicular to the non-linear edge of the plate for applying the force to the non-linear edge, and a set of forming rollers mounted on the first shafts and adjacent to the anti-buckling rollers for shaping side surfaces of the thickened non-linear edge and controlling the thickness thereof.

11. The apparatus, as set forth in claim 9, wherein the forming means includes sets of interchangeable forming rollers which sets may be interchanged to produce different shapes of the thickened non-linear edge.

12. A method of forming a thickened edge on a plate of formable material having a non-linear edge by working the non-linear edge of the plate into a prescribed thickness and shape, comprising:

holding the plate and engaging the non-linear edge of the plate with a forming apparatus;

applying force to the forming apparatus in one direction toward the non-linear edge and in a magnitude sufficient to form the thickened edge;

moving the forming apparatus transversely relative to the plate in a direction cross-wise of the one direction;

determining the orientation of the non-linear edge relative to said one direction; and automatically adjusting the forming apparatus so that the magnitude of the force is substantially constant in a direction perpendicular to the non-linear edge of the plate to form a generally uniform thickened edge.

13. A method of forming a thickened edge on a plate of formable material as set forth in claim 12, wherein the forming apparatus includes a roller rotatably mounted on a shaft extending perpendicular to the plate, and including the step of upsetting the non-linear edge of the plate with the first roller.

14. An apparatus for selectively forming a thickened edge on a plate of formable material by working the material along a non-linear edge of the plate to form the thickened edge into a desired shape and thickness, comprising:

a support and means for holding the plate on the support;

a forming apparatus adjacent the support;

a load frame for carrying the forming apparatus;

means for applying a load to the forming apparatus through the load frame;

means for determining the orientation of the non-linear edge relative to the forming apparatus;

means for automatically adjusting the forming apparatus to maintain a generally constant prescribed pressure on the non-linear edge of the plate as measured perpendicular thereto; and means for moving the load frame relative to the plate to produce a prescribed thickened edge along the non-linear edge of the plate.

15. An apparatus for selectively forming a thickened edge on a plate of formable material as set forth in claim 14, wherein the forming apparatus includes sets of interchangeable forming rollers which sets may be interchanged to produce different shapes of the thickened non-linear edge.

16. The apparatus, as set forth in claim 14, including a slide frame for carrying the forming apparatus, and means for reciprocally supporting the slide frame to move the forming apparatus relative to the table.

17. The apparatus, as set forth in claim 16, wherein the means for applying a load to the forming apparatus is anchored to the load frame and attached to the slide frame.

18. The apparatus, as set forth in claim 16, wherein the forming apparatus comprises a set of anti-buckling rollers rotatably mounted on the adjustable slide to engage outer surfaces of the plate adjacent the non-linear edge, a first roller mounted perpendicular to the plate for applying pressure to the non-linear edge of the plate to upset the same, and a set of forming rollers mounted adjacent the anti-buckling rollers, said forming rollers being spaced a preselected distance from each other on opposite sides of the plate for shaping side surfaces of the thickened edge and controlling the thickness thereof.

19. The apparatus, as set forth in claim 16, including a motor anchored to the load frame and attached to the slide frame for applying the load to the forming apparatus.

20. The apparatus, as set forth in claim 19, wherein the means for adjusting the load to the forming apparatus comprises a hydraulic control circuit to control the pressure in the hydraulic motor and an electronic control to control the hydraulic circuit, the electronic control having means to determine the position of the plate in relation to the forming apparatus, system pressure sensing means, and means for comparing the plate position and the system pressure with predetermined data whereby appropriate signals are produced to vary the system pressure to maintain a prescribed pressure of the first roller along a line of force extending from the axis of the first roller perpendicular to the edge of the plate.

* * * * *